US006509306B1

(12) United States Patent
Wisniewski et al.

(10) Patent No.: US 6,509,306 B1
(45) Date of Patent: Jan. 21, 2003

(54) LIGHT DUTY LIQUID CLEANING COMPOSITIONS

(75) Inventors: Karen Wisniewski, Bound Brook, NJ (US); Barbara Thomas, Princeton, NJ (US); Marc Paye, Hognoul (BE)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/064,247

(22) Filed: Jun. 25, 2002

Related U.S. Application Data

(63) Continuation of application No. 10/008,679, filed on Dec. 7, 2001, now Pat. No. 6,429,180.

(51) Int. Cl.[7] ..... C11D 17/00

(52) U.S. Cl. ..... 510/218; 510/426; 510/428; 510/432; 510/466; 510/470; 510/503; 510/506

(58) Field of Search ..... 510/218, 426, 510/428, 432, 466, 470, 503, 506

(56) References Cited

U.S. PATENT DOCUMENTS

| | | | | | |
|---|---|---|---|---|---|
| 5,160,655 | A | * | 11/1992 | Donker et al. | 252/95 |
| 5,866,529 | A | * | 2/1999 | Erilli et al. | 510/425 |
| 5,981,466 | A | * | 11/1999 | Morelli et al. | 510/499 |
| 6,214,781 | B1 | * | 4/2001 | Gambogi et al. | 510/218 |

* cited by examiner

*Primary Examiner*—Necholus Ogden
(74) *Attorney, Agent, or Firm*—Richard E. Nanfeldt

(57) ABSTRACT

A light duty liquid detergent with desirable cleansing properties to the human skin and dishes comprising a C8–18 ethoxylated alkyl ether sulfate anionic surfactant, a sulfonate anionic surfactant, an alkyl polyglucoside surfactant, an amine oxide, silicone polymer and water.

6 Claims, No Drawings

LIGHT DUTY LIQUID CLEANING COMPOSITIONS

CROSS REFERENCE TO RELATED APPLICATIONS

This application is a continuation in part application of U.S. Ser. No. 10/008,679, filed Dec. 7, 2001 now U.S. Pat. No. 6,429,180.

BACKGROUND OF INVENTION

1. Field of Invention

This invention relates to a light duty liquid cleaning composition which is mild to the skin and which demonstrates improved sensory attributes and foam when used as a hand soap designed in particular for dishware and which is effective in grease and is high foaming and clear.

2. Background of the Invention

The present invention relates to light duty liquid detergent compositions with high foaming properties, which contains mixtures of anionic surfactants, amine oxide surfactant, alkyl polyglucoside surfactant and an oxyethylene functional organosilane.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

U.S. Pat. Nos. 5,326,557 and 5,435,996 disclose oxyethylene functional organic silanes for use in body care formulations.

SUMMARY OF INVENTION

It has now been found that a light duty liquid detergent can be formulated with a mixture of anionic surfactants, alkyl polyglucoside, alkyl monoalkanol amide, surfactant, silicone polymer and water which has desirable cleaning properties, mildness to the skin and improved foam qualities.

An object of this invention is to provide a light duty liquid detergent composition which comprises a sulfate surfactant, a sulfonate anionic surfactant, alkyl monoalkanol amide, an alkyl polyglucoside surfactant, an oxyethylene functional organosilane, solubilizing system and water wherein the composition does not contain an amine, enzyme, propanediol, or an aminopolyphosphate.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION

The light duty liquid compositions of the instant invention comprises approximately by weight: (a) 2% to 12%, more preferably 3% to 10% of an alkali metal or ammonium salt of a C8–18 ethoxylated alkyl ether sulfate and/or an C8–18 alkyl ether sulfate; (b) 20% to 36%, more preferably 22% to 34% of an alkali metal or alkaline earth metal salt of an anionic sulfonate surfactant; (c) 0.5% to 10%, more preferably 1.0% to 8% of an alkyl polyglucoside surfactant; (d) 0.5% to 6% of a sodium xylene sulfonate and/or sodium cumene sulfonate; (e) 1% to 12% of an amine oxide surfactant; (f) 0.1% to 6%, more preferably 1% to 5% of a silicone polymer which functions as a mildness and foam enhancing agent; (g) 0 to 4%, more preferably 0.5% to 3% of an inorganic magnesium salt;(h) 0 to 6%, more preferably 0.25% to 4% of a C1–C4 alkanol; and (i) the balance being water, wherein the composition does not contain an amine, enzyme, propanediol, or an aminopolyphosphate.

The instant compositions do not contain an N-alkyl aldonamide, choline chloride or buffering system which is a nitrogenous buffer which is ammonium or alkaline earth carbonate, guanidine derivates, alkoxylalkyl amines, alkyleneamines, C3–C7 alkyl and alkenyl monobasic and dibasic acids such as C4–C7 aliphatic carboxylic diacids which do not contain a hydroxy group, phosphoric acid, amino alkylene phosphonic acid and the composition is pourable and is not a gel and the composition has a complex viscosity at 1 rads–1 of less than 0.4 Pascal seconds.

The anionic sulfonate surfactants which may be used in the instant composition of this invention are water soluble and include the magnesium sodium, potassium, ammonium and ethanolammonium salts of linear C8–C16 alkyl benzene sulfonates; C10–C20 paraffin sulfonates, alpha olefin sulfonates containing about 10–24 carbon atoms and C8–C18 alkyl sulfates and mixtures thereof. The preferred anionic sulfonate surfactant is a C12–18 paraffin sulfonate.

The paraffin sulfonates may be monosulfonates or di-sulfonates and usually are mixtures thereof, obtained by sulfonating paraffins of 10 to 20 carbon atoms. Preferred paraffin sulfonates are those of C12–18 carbon atoms chains, and more preferably they are of C14–17 chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the C14–17 range will be minor and will be minimized, as will be any contents of di- or poly-sulfonates.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or C8–15 alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The C8–18 ethoxylated alkyl ether sulfate surfactants have the structure $$R—(OCHCH_2)_nOSO^-{}_3M^+$$

wherein n is about 1 to about 22 more preferably 1 to 3 and R is an alkyl group having about 8 to about 18 carbon atoms, more preferably 12 to 15 and natural cuts, for example, C12–14 or C12–16 and M is an ammonium cation or a metal cation, most preferably sodium.

The ethoxylated alkyl ether sulfate may be made by sulfating the condensation product of ethylene oxide and C8–10 alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 1 5 carbon atoms in the alcohols and in the alkyl groups thereof, e.g., sodium myristyl (3 EO) sulfate.

Ethoxylated C8–18 alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol.

The amine oxide semi-polar nonionic surfactants used in the instant compositions comprise compounds and mixtures of compounds having the formula

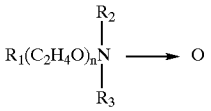

wherein R1 is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, R2 and R3 are each methyl, ethyl, propyl, isopropyl, 2-hydroxyethyl, 2-hydroxypropyl, or 3-hydroxypropyl, and n is from 0 to 10. Particularly preferred are amine oxides of the formula:

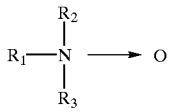

wherein R1 is a C12–16 alkyl and R2 and R3 are methyl or ethyl. The above ethylene oxide condensates, amides, and amine oxides are more fully described in U.S. Pat. No. 4,316,824 which is hereby incorporated herein by reference.

The alkyl polysaccharides surfactants, which are used in conjunction with the aforementioned surfactant have a hydrophobic group containing from about 8 to about 20 carbon atoms, preferably from about 10 to about 1 6 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)_r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol (R2OH) can be reacted with glucose, in the presence of an acid catalyst to form the desired glucoside. Alternatively the alkyl polyglucosides can be prepared by a two step procedure in which a short chain alcohol (R1OH) can be reacted with glucose, in the presence of an acid catalyst to form the desired glucoside. Alternatively the alkyl polyglucosides can be prepared by a two step procedure in which a short chain alcohol (C1–6) is reacted with glucose or a polyglucoside (x=2 to 4) to yield a short chain alkyl glucoside (x=1 to 4) which can in turn be reacted with a longer chain alcohol (R2OH) to displace the short chain alcohol and obtain the desired alkyl polyglucoside. If this two step procedure is used, the short chain alkylglucosde content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%); and n=18 (0.5%) and x (degree of polymerization)=1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

The organosilane used in the instant composition is a mixture of dimethicone polymer and cyclomethicone. An especially preferred organosilane is manufactured by Dow Chemical as 9040 Silicone Elastomer blend.

The instant light duty liquid nonmicroemulsion compositions contain about 0 to about 10 wt. %, more preferably about 1 wt. % to about 8 wt. %, of at least one solubilizing agent selected from the group consisting of a C1–4 mono, dihydroxy or polyhydroxy alkanols such as ethanol, isopropanol, glycerol ethylene glycol, diethylene glycol and propylene glycol and mixtures thereof and an alkali metal cumene or xylene sulfonates such as sodium cumene sulfonate and sodium xylene sulfonate. The solubilizing agents are included in order to control low temperature cloud clear properties.

The magnesium inorganic salt used in the instant composition is selected from the group consisting of magnesium oxide, magnesium chloride, and magnesium sulfate hepta hydrate and mixtures thereof.

The instant cleaning compositions explicitly exclude alkali metal silicates and alkali metal builders such as alkali metal polyphosphates, alkali metal carbonates and alkali metal phosphonates because these materials, if used in the instant composition, would cause the composition to have a high pH as well as leaving residue on the surface being cleaned.

The final essential ingredient in the inventive cleaning compositions having improved interfacial tension properties is water. The proportion of water in the compositions generally is in the range of 35% to 90%, preferably 50% to 85% by weight of the cleaning composition.

The liquid cleaning composition of this invention may, if desired, also contain other components either to provide additional effect or to make the product more attractive to the consumer. The following are mentioned by way of example: Colors or dyes or perfumes in amounts up to 1.0% by weight; preservatives or antioxidizing agents, such as formalin, 5-bromo-5-nitro-dioxan-1,3; 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added. Other ingredients in amounts up to 5 wt. % are ethylene diamine tetraacetic acid sodium salt, hydroxy ethylene diamine tetraacetic acid sodium salt, Dowicil 75 and sodium bisulfite.

In final form, the instant compositions exhibit stability at ambient temperatures. More specifically, such compositions remain clear and stable in the range of 15° C. to 35° C., especially 20° C. to 30° C. Such compositions exhibit a pH of 6 to 9.0. The liquid cleaning compositions are readily pourable and exhibit a viscosity in the range of 400–800 centipoise (cps) as measured at 25° C. with a Brookfield RVT Viscometer using a #21 spindle rotating at 20 RPM.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following reference composition in wt. % was prepared by simple mixing procedure:

| | Ref. | A |
|---|---|---|
| Linear alkyl benzene sulfonate sodium salt | 3 | 3 |
| $NH_4$ $C_{13-14}$ AE0S 2:1 EO | 11.6 | 11.6 |
| Linear alkyl benzene sulfonate Mg salt | 9 | 9 |
| Lauryl myristylamido propyl dimethyl amine oxide | 5.5 | 5.5 |
| APG 625 | 10.0 | 10.0 |
| Cyclomethicone/dimethicone cross polymer (9040 Silicone Elastomer blend) | 0 | 2 |
| Water | Bal. | Bal. |
| pH | 6.8–7.0 | 6.8–7.0 |
| Viscosity (Brookfield viscometer at 25C, spindle 21, 20 RPMS) cps | 400 | 650 |

Although a standard inverted cylinder test shows a slight decrease in foaming compared to a control formula without the elastomer, panelists handwashing with the product showed increased foam level and increased foam longevity compared to control. The sensory attributes of the foam were also superior to that of the control.

What is claimed is:

1. A clear light duty liquid dishwashing composition which comprises approximately by weight:

(a) 2% to 12% of an alkali metal or ammonium salt of a C8–18 ethoxylated alkyl ether sulfate and/or a C8–18 alkyl sulfate;

(b) 20% to 36% of an alkaline earth metal or alkali metal salt of an anionic C9–C18 alkyl benzene sulfonate surfactant;

(c) 0.5% to 10% of an alkyl polyglucoside surfactant;

(d) 0 to 10% of at least one solubilizing agent;

(e) 1% to 12% of a lauryl myristylamido propyl dimethyl amine oxide;

(f) 1% to 6% of a silicone polymer; and (g) the balance being water wherein the composition does not contain an amine, enzyme, propanediol, amino polyphosphate, N-alkyl aldonamide, choline chloride, or buffering system which is a nitrogenous buffer which is ammonium or alkaline earth carbonate, guanidine derivatives, alkoxylalkyl amine, alkyleneamines, C3–C7 alkyl and alkenyl monobasic and dibasic acids such as C4–C7 aliphatic carboxylic diacids which do not contain a hydroxy group, phosphoric acid, amino alkylene phosphonic acid and the composition is pourable and is not a gel and the composition has a complex viscosity at 1 rads–1 of less than 0.4 Pascals seconds.

2. The composition of claim 1, wherein said solubilizing agent is selected from the group consisting of sodium, potassium, ammonium salts of cumene, xylene, toluene sulfonates and mixtures thereof.

3. The composition of claim 1, wherein said solubilizing agent is sodium xylene sulfonate.

4. The composition of claim 1, wherein said solubilizing agent is selected from the group consisting of isopropanol, ethanol, glycerol, ethylene glycol, diethylene glycol and propylene glycol and mixtures thereof.

5. The composition of claim 2, further including a magnesium inorganic acid.

6. The composition of claim 5, further including a C1–C4 alkanol.

* * * * *